United States Patent [19]

Rogers, III

[11] Patent Number: 4,607,787

[45] Date of Patent: Aug. 26, 1986

[54] ELECTRONIC CONTROL AND METHOD FOR INCREASING EFFICIENCY OF HEATING

[76] Inventor: Charles F. Rogers, III, 10 Moraga Dr., Chico, Calif. 95927

[21] Appl. No.: 722,516

[22] Filed: Apr. 12, 1985

[51] Int. Cl.[4] ..... F25B 19/00

[52] U.S. Cl. ..... 236/11; 62/231; 165/12

[58] Field of Search ..... 236/10, 11, 46 F, 46 R; 165/12; 62/231

[56] References Cited

U.S. PATENT DOCUMENTS

| | | | |
|---|---|---|---|
| 3,921,899 | 11/1975 | Hamilton | 236/11 X |
| 4,090,663 | 5/1978 | Bonne et al. | 236/10 |
| 4,136,730 | 1/1979 | Kinsey | 165/12 |
| 4,199,023 | 4/1980 | Phillips | 165/20 |
| 4,487,361 | 12/1984 | Brown | 236/11 |

*Primary Examiner*—William E. Wayner

*Attorney, Agent, or Firm*—Leonard D. Schappert

[57] ABSTRACT

A method of increasing the efficiency of a hot air furnace by measuring the temperature differential across the heated air inlet and outlet plenums which occurs during normal operation of the furnace to raise the room temperature from its turn on point to its turn off point. The plenum temperature differential is then used to time cycle the burner.

5 Claims, 3 Drawing Figures

ELECTRONIC CONTROL AND METHOD FOR INCREASING EFFICIENCY OF HEATING

BACKGROUND OF THE INVENTION

1. Field of the Invention

This invention relates generally to the area of heating and cooling systems, and more specifically to electronic control systems designed to increase the efficiency of central heating and cooling air conditioning systems.

2. Description of the Prior Art

Heretofore, temperature control systems for use with heating and air conditioning units, hereinafter referred to as "HVACs," have consisted of thermostats which turn the heating or cooling unit on or off when a given temperature is reached. Further improvements have been accomplished through the use of timers which limit the period of use of the HVAC. Additional improvements have included controls using a relay together with a time delay in conjunction with a thermostat, so that the fan operates for a preset time after the HVAC unit is turned off, thereby clearing the duct of any available warm or cool air. Applicant is unaware of any prior art teaching a device or method which combines a differential thermostat sensing both the supply and return duct temperatures with a computerized control unit having the unique features as taught herein.

SUMMARY OF THE INVENTION

The present invention comprises a control unit for use with HVAC's which is designed to increase energy efficiency during operation of existing equipment. The control unit is operationally positioned between the room thermostat which would normally control the HVAC unit and the HVAC unit itself, so that it is in a position to control the HVAC. The control unit could be modified to include a thermostat function and thus obviate a separate thermostat. The control unit is capable of deactivating the HVAC equipment even though the thermostat is in an "on" condition; however, unless the thermostat indicates a demand, the control unit will not activate the HVAC unit except for operation of the fan as discussed herein. In connecting the control unit, the operator disconnects the thermostat and connects the control unit in place of the thermostat. The thermostat is then connected to the control unit as shown in the drawings and discussed later herein. The control unit senses temperature at both the supply duct and the return duct of the HVAC system, compares the two temperatures, computes the rise and modifies operation of the system on the basis of the computed data. The rise referred to herein is the mathematical difference between the temperatures in the supply duct and the return duct. On the basis of the computed data, the control unit cycles the burner or compressor of the HVAC unit on and off, increasing the efficiency of the system. As it performs this function, it also senses the supply and return duct temperatures and continues to operate the fan after the burner or compressor of the HVAC unit is deactivated. The fan continues to operate until the temperature difference between the supply and return ducts ("rise") is reduced to a computed level. The control unit does not operate on absolute temperature variations in either of the ducts, but rather on the differential ("rise") between the ducts. Then, having read the demand, it operates the HVAC unit.

In operating the HVAC in the heating mode, the control unit increases efficiency by preventing the heat exchanger from exceeding saturation (that is, the point at which the temperatures of the inside and outside surfaces of the heat exchanger wall are substantially equal), thereby limiting the loss of heat through a flue. Exceeding saturation dramatically reduces efficiency. Efficiency is further increased because the control unit leaves the fan on to clear the flue of warm air after the burner is deactivated.

In operating the HVAC in the cooling mode, the control unit operates the compressor in the HVAC in its most efficient mode by cycling on and off, allowing head pressure to be equalized, and by evaporating moisture on the cooling coils, and by clearing the ducts of the remaining cool air during a "coasting" period with the evaporator fan on and the compressor off.

One of the objects of the present invention is to provide an electronic control unit which is capable of increasing the efficiency of an HVAC system.

Another object of the present invention is to provide a control unit for HVAC systems which is relatively inexpensive to build and to operate.

A further object of the present invention is to provide a method of controlling HVAC systems so as to maximize efficiency at a minimum cost.

A further object of the present invention is to provide a control unit for use with HVAC systems which increases efficiency dramatically.

Another object of the present invention is to compute and determine the equipment's present level of energy efficiency (fuel utilization) and the increased efficiency resulting from the use of the control unit, and then to display the savings realized in percentage form.

The foregoing objects, as well as other objects and benefits of the present invention, are made more apparent by the descriptions and claims which follow.

DESCRIPTION OF THE PREFERRED EMBODIMENT

Figure 1:
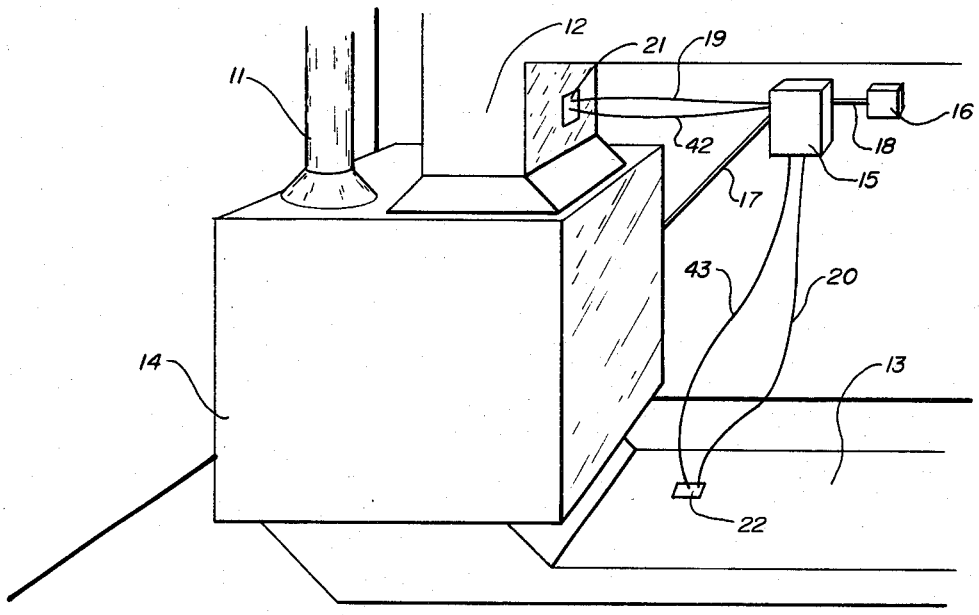
FIG. 1 is a perspective view of an HVAC unit with associated ducting and hardware.

FIG. 1 shows a perspective view of an HVAC 14 with flue 11 and having an outlet, supply duct 12, and an inlet, return duct 13. Though such is not shown in the drawings, HVAC 14 includes a burner for heating, an evaporator and condenser coils for cooling, an air circulating fan, and a transformer. For purposes of simplicity, a room thermostat 16 is shown beside HVAC 14. Room thermostat 16 would normally be connected to HVAC 14 through lines 17 and 18. However, in the present invention, a control unit 15 is connected to HVAC 14 by line 17, and room thermostat 16 is connected to control unit 15 by line 18. Control unit 15 is also attached by lines 19 and 42 to a temperature sensing means, temperature sensor 21, in the supply duct 12 of HVAC 14, and through lines 20 and 43 to a temperature sensing means, temperature sensor 22, in return duct 13 of HVAC 14. Control unit 15 senses temperatures in supply duct 12 and return duct 13 and modifies the operation of HVAC 14 on the basis of computed variations between those temperatures. Thermostat 16 is used by control unit 15 to determine when demand is present, whether the demand is for heat, cool or manual fan, and when the demand is satisfied. While thermostat 16 is here used as a switch to indicate demand, a manually operated switch could be connected in place of thermostat 16 if desired. Control unit 15 is also usable with a convection or gravity heater rather than an HVAC, in which case a fan may or may not be used.

Figure 2:
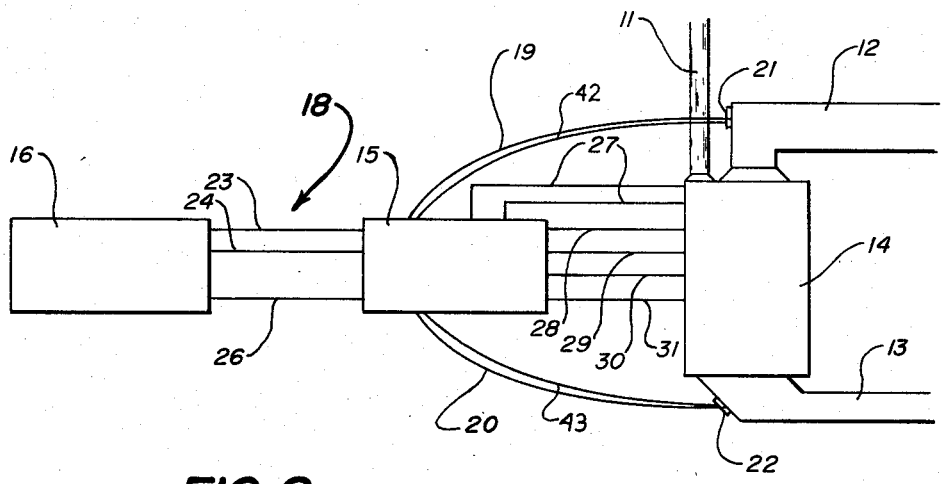
FIG. 2 is an operational view showing the connection of the control unit between the room thermostat and the HVAC unit.
Figure 3:
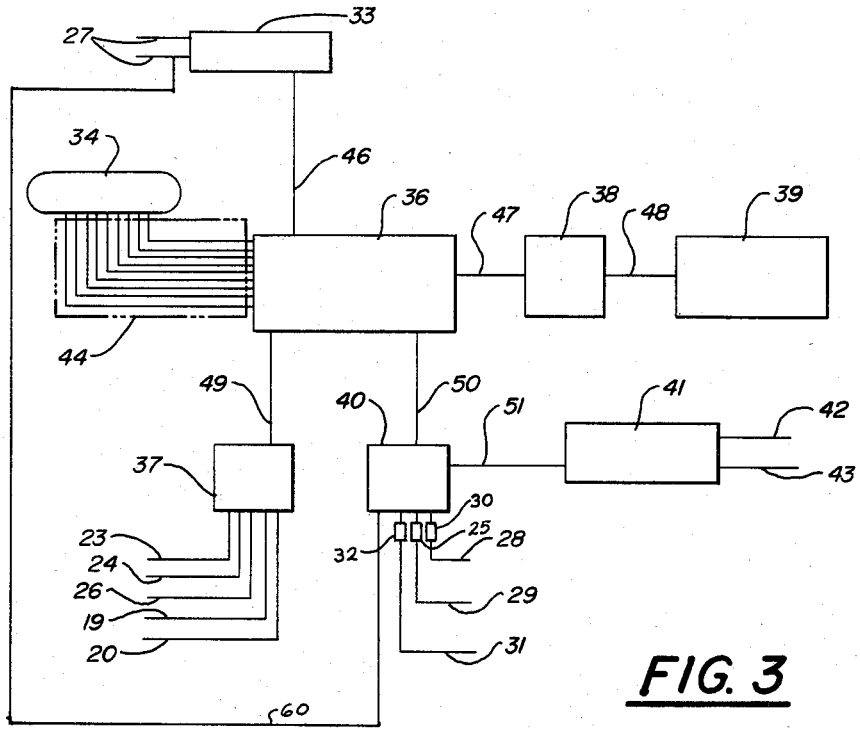
FIG. 3 is a block diagram of the control unit showing the basic components utilized and their interconnection.

FIGS. 2 and 3 show control unit 15 and its connection to room thermostat 16 and HVAC 14. The actual construction of one embodiment of control unit 15 is shown in FIG. 3 of the drawings. Control unit 15 consists of a microprocessor 36 connected through line 47 to a RAM chip 38. RAM chip 38 is connected to EPROM memory chip 39 through lines 48. In one variation, the microprocessor 36 has an internal RAM which takes the place of RAM chip 38. Basic programming of the functioning of the unit is provided by EPROM memory chip 39. Display 34 is provided to monitor operation of control unit 15, and is attached to microprocessor 36 by lines 44. Microprocessor 36 is connected to input buffer 37 through line 49. Input buffer 37 is utilized to input data from room thermostat 16, and monitors heat demand through line 23, cooling demand through line 24, and the fan of HVAC 14 through line 26. Input buffer 37 further monitors temperature sensor 21 in supply duct 12 through lines 19 and 42, and temperature sensor 22 in return duct 13 through lines 20 and 43. Output buffer 40 is attached to microprocessor 36 by line 50, and controls HVAC 14 through the use of relays 25, 30 and 32, which route power to the burner, fan and compressor of HVAC 14 through lines 28, 29 and 31, specifically controlling heating through line 28, cooling through line 29, and fan through line 31. Control voltage to operate relays 25, 30 and 32, which actuate HVAC 14 through lines 28, 29 and 31, is provided by line 60, which is attached to line 27, which is connected to a transformer in HVAC 14 or other appropriate power supply. Output buffer 40 is connected to constant known voltage source 41 through line 51, and directs voltage to temperature sensor 21 through line 42 and to temperature sensor 22 through line 43. Power is provided to power supply 33 by line 27, which is connected to a 24-volt transformer in HVAC 14. Power supply 33 provides power through line 46 to operate microprocessor 36, as well as other components in control unit 15.

OPERATION

Control unit 15 is connected to the components of HVAC 14 and to room thermostat 16 and temperature sensors 21 and 22 in supply duct 12 and return duct 22 as shown in the drawings. EPROM memory chip 39 is programmed to establish optimal operation (i.e., cycling) of HVAC 14 to substantially increase efficiency in all types of weather conditions.

Initially, in a calibration mode, control unit 15 operates HVAC 14 in an uncycled or uncontrolled standard mode based on demand indicated by room thermostat 16 while monitoring information and recording it in RAM chip 38. In this mode it notes various performance data during normal operation of the HVAC 14. This includes temperature variation between the supply duct 12 and return duct 13 during normal operation of the system. Using information gathered and the program in EPROM memory chip 39, it creates its own program variables, based upon collected data, and calculations. Thus, utilizing the program in EPROM chip 39, it adjusts the equipment's operation to match the building, equipment used, occupants, temperature settings desired, type of fuel used and exterior weather conditions to provide the most fuel-efficient and economical mode of operation.

Data monitored and recorded include return duct temperature, supply duct temperature, temperature differential between supply and return ducts, demand time, total time during which fuel is consumed, energy-used coefficient (to determine savings), and rise maximum during a preset period.

Monitoring is automatically performed during the calibration mode when no data are present in RAM chip 38. This occurs at the time of installation, any time power is interrupted, or whenever recalibration to maintain efficiency is desired (normally weekly).

When monitoring is complete, one of two programs—for either heating or cooling—will be used to maximize efficiency.

For heating, the program cycles the HVAC's burner "on" until the temperature differential between supply and return ducts reaches a first percentage (e.g., 85%) of the rise in a preset period of time (e.g., 5 minutes) as recorded previously during monitoring, and "off" until the temperature differential between supply and return ducts reaches a second percentage (e.g., 60%), lower than the aforementioned first percentage of the rise. This cycling continues until room thermostat 16 indicates the demand has been satisfied. To further enhance efficiency, the fan is held "on" until demand indicated by room thermostat 16 is satisfied and the supply duct temperature drops below a preset temperature (e.g., 100 degrees Fahrenheit).

With the system in the cooling mode, for purposes of calibration the program of control unit 15 activates the air conditioner and continues operation until the demand indicated by room thermostat 16 is satisfied. Data are monitored as previously noted and logged into memory. When demand is again indicated by room thermostat 16, the program cycles the air conditioner compressor on and off for preset segments of calibrated time periods; for example, on for one-fifth of the time required to satisfy the demand indicated by room thermostat 16 in the calibration mode and off for a minimum of three minutes or a sufficient time to allow the compressor head pressure to equalize. The program continues to operate the fan during each "off" period until a preset temperature (e.g., 66 degrees Fahrenheit) is reached in the supply duct, at which point, if sufficient time has elapsed to allow the compressor head pressure to equalize, it reactivates the compressor. Control unit 15 continues to cycle the air conditioner compressor on and off until the demand indicated by the room thermostat 16 is satisfied. When the demand is satisfied, the compressor is deactivated and the program holds the fan on until the air in the supply duct reaches a preset temperature (e.g., 68 degrees Fahrenheit). Efficiency is gained partly as a result of clearing the ducts of cooler air, and also through the evaporation of moisture on the cooling coils which occurs during the "coasting" period.

The program utilized also provides for displaying the calculated percentage of savings. This figure is determined with calculations performed on the basis of efficiency realized during the calibration period versus efficiency realized during operation utilizing the techniques taught herein. This calculation, which is performed by the control unit 15, is based on the following formulae:

$$\frac{\text{standard output}}{\text{standard input}} = \%\ \text{efficiency with standard operation}$$

$$\frac{\text{output using control unit}}{\text{input using control unit}} = \%\ \text{efficiency using control unit}$$

$$100 \times \frac{\%\ \text{efficiency using control unit} - \%\ \text{efficiency without control unit}}{\%\ \text{efficiency using control unit}} = \%\ \text{savings displayed}$$

While the foregoing description of the invention has shown a preferred embodiment using specific terms, such description is presented for illustrative purposes only. It is applicant's intention that changes and variations may be made without departure from the spirit or scope of the following claims, and this disclosure is not intended to limit applicant's protection in any way.

What is claimed is:

1. A method of increasing efficiency of a heating system having a burner, a control to turn said burner on and off and an inlet whereby cool air enters said heating system and an outlet whereby warm air exits said heating system, comprising:

positioning a first temperature sensing means in said in1et;

positioning a second temperature sensing means in said outlet;

measuring temperature rise between said inlet and said outlet occurring during normal operation of said heating system in heating a room from a first temperature to a second temperature;

cycling said burner on when said room reaches said first temperature until the temperature differential between said outlet and said inlet reaches a first percentage of said temperature rise which occurred during normal operation of said heating systen and off until the temperature differential between said outlet and said inlet reaches a second percentage of said temperature rise which occurred during normal operation and continuing said cycling until said room reaches said second temperature reached during normal operation.

2. The method of claim 1, wherein said heating system includes a fan for circulating air through said heating system and wherein said fan is held on until said room reaches said second temperature.

3. The method of claim 2, wherein said fan is held on after cycling until said outlet reaches a third temperature.

4. The method of claim 1, including disconnecting said control, positioning a microcomputer having a room temperature sensor in its place and programming said microcomputer to monitor room temperature, said first and second temperature sensing means and said heating system, and to operate said heating system accordingly.

5. The method of claim 4, including programming said microcomputer to compute the increase in efficiency due to said microcomputer on the basis of the following formulae:

$$100 \times \frac{\frac{\text{controlled output}}{\text{controlled input}} - \frac{\text{normal output}}{\text{normal input}}}{\frac{\text{controlled output}}{\text{controlled input}}} = \%\ \text{savings,}$$

and displaying said percentage savings.

* * * * *